United States Patent [19]

Agar

[11] Patent Number: 4,488,959

[45] Date of Patent: Dec. 18, 1984

[54] SCHEELITE FLOTATION PROCESS

[76] Inventor: Gordon E. Agar, 123 Avodale Ct., Burlington, Ontario, Canada, L7L 2M8

[21] Appl. No.: 416,915

[22] Filed: Sep. 13, 1982

[30] Foreign Application Priority Data

Sep. 21, 1981 [GB] United Kingdom ..... 8128467

[51] Int. Cl.[3] ..... B03D 1/14

[52] U.S. Cl. ..... 209/167; 209/166; 252/61

[58] Field of Search ..... 209/167, 166; 252/61

[56] References Cited

U.S. PATENT DOCUMENTS

| | | | |
|---|---|---|---|
| 2,164,063 | 6/1939 | Handy | 209/166 |
| 2,373,305 | 4/1945 | Gieske | 209/166 |
| 2,607,479 | 8/1952 | Bates | 209/166 |
| 3,094,485 | 6/1963 | Gaudin et al. | 209/167 |
| 3,915,391 | 10/1975 | Mercade . | |
| 3,985,645 | 10/1976 | Noblitt . | |
| 4,054,442 | 10/1977 | Vedova et al. . | |
| 4,208,275 | 6/1980 | Gomes et al. | 209/167 |
| 4,213,942 | 7/1980 | Thornton | 209/166 |
| 4,366,050 | 12/1982 | Olin et al. | 209/166 |

OTHER PUBLICATIONS

Yih, Stephen, W. H. and Chun, T. Wang, Tungsten, Plenum Press, New York, pp. 58–81, 1979.

Tungsten, Proceedings of the First International Tungsten Symposium, Stockholm, 1979, Mining Journal Books Ltd., London, 1979.

Tungsten, Mineral Commodity Profiles, MCP-21, Sep. 1978, U.S. Dept. of the Interior, Washington, DC, pp. 7–9.

V. I. Klassen and V. A. Mokrousov, An Introduction to the Theory of Flotation, Butterworths, London, 1963, pp. 320–335.

A. M. Gaudin, Flotation, McGraw-Hill Book Co., Inc., New York, 1957, pp. 481–482.

Flotation, A. M. Gaudin Memorial Volume, M. C. Fuerstenan Editor: vol. 1, Aime, Denver, 1976, Chapter 21, Selective Flotation of Scheelite, (L. A. Vazquez, S. Ramachandran & N. L. Grauerholz), pp. 580–596.

Mitchell, W., C. L. Sollenberger and T. G. Kirkland, Flotation Tests on Korean Scheelite Ore, Tr. Aime, (SME), 190, 60, (1951).

Sollenberger, C. L. and R. B. Greenwalt, Relative Effectiveness of Sodium Silicates of Different Silica-Soda Ratios as Gangue Depressants in Nonmetallic Flotation, Tr. Aime, (SME), 211, 691, (1958).

Fuerstenau, M. C., G. Gutierrez and D. A. Elgillani, The Influence of Sodium Silicate in Nonmetallic Flotation Systems, Tr. Aime, (SME), 241, 319, (1968).

Barskii, L. A., M. M. Sorokin, L. I. Ratmirova and KH. D. Kardanov, Increasing the Scheelite Flotation Rate, Tsvetnye Metally, 14, No. 9, 80, (1973).

Shoji, K., Y. Takamura, A. Kuroda and J. Shimdiizaka, Mineral Processing of Low Grade Bismuth-Tungsten Ore at Akagane Mine, Japan, 10th IMPC, IMM Publisher, London, 1973, pp. 667–679.

Arnold, R. and L. J. Warren, Electrokinetic Properties of Scheelite, J. Coll. Int. Sci., 47, No. 1, pp. 134–144, (1974).

Auge, P., A. Bahr and H. Koser, Selective Depression of Silicates in Scheelite Flotation with Fatty acids, 11th IMPC Aziende Tipografiche Bardi, Rome, 1975, pp. 691–712.

Warren, L. G., Slime Coating and Shear Flocculation in the Scheelite-Sodium Oleate System, Tr. IMM 84, No. 823, C99–104, 1975.

(List continued on next page.)

*Primary Examiner*—Bernard Nozick

[57] ABSTRACT

A process for separating scheelite from gange wherein the ore is ground with 0.4 to 10 grams of alkali metal carbonate per kg. of ore, forming a pulp and removing sulfide minerals from pulp liquor. Carrying out froth floatation in the presence of paraffin oil, 0.1–0.4 gram of fatty acid per kg. of ore and 3.2–5.5 grams of sodium silicate per kg. of ore wherein the weight ratio of paraffin oil to fatty acid is 0.5:1 to 2.8:1.

15 Claims, 10 Drawing Figures

OTHER PUBLICATIONS

Figure 1:
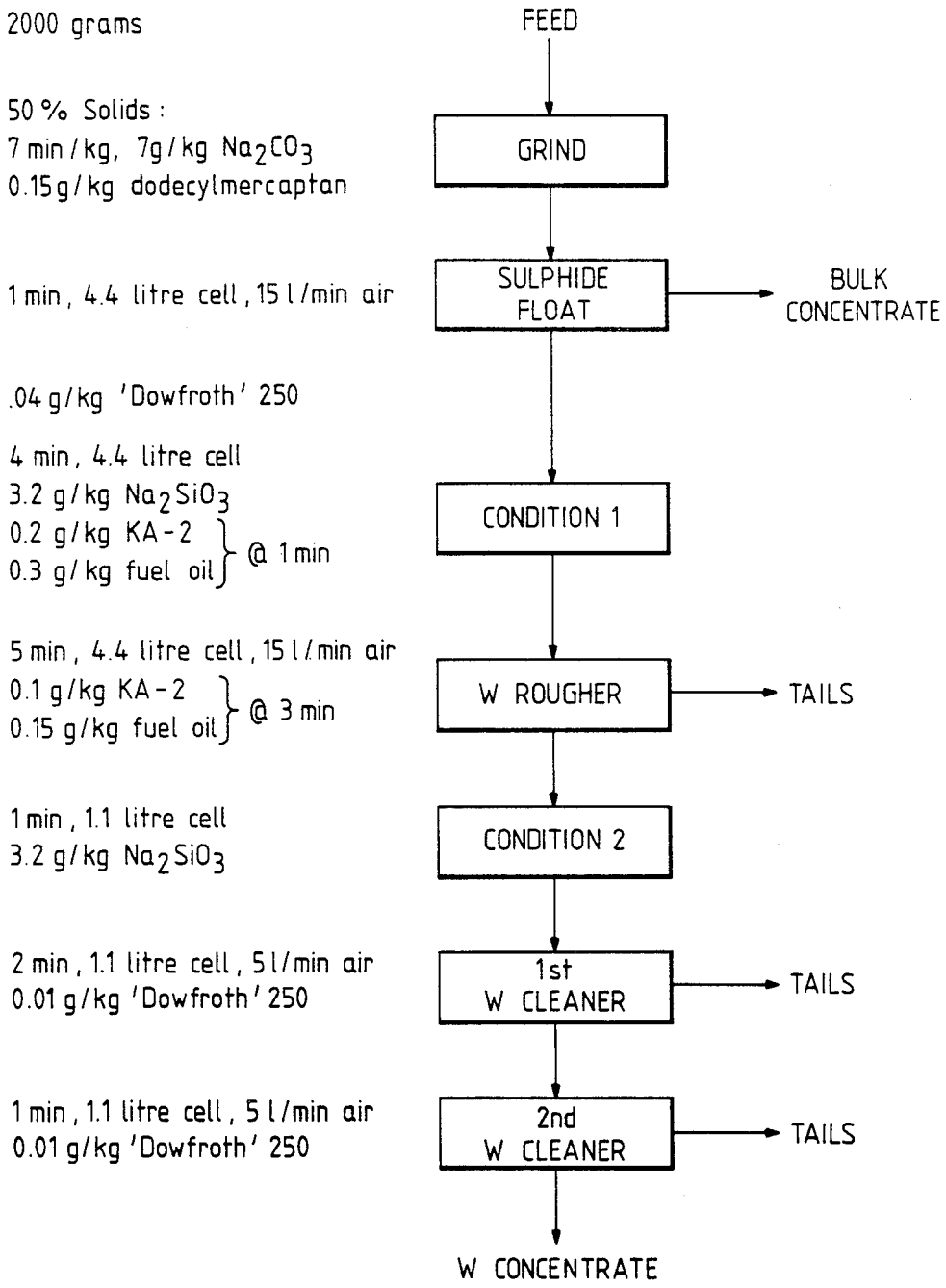

Arnold, R., E. E. Brownbill and S. W. Ihle, Hallimond Tube Flotation of Scheelite and Calcite with Amines, Int'l. Jnl. of Mineral Processing, 5, 143-152, (1978).

Mercade, Ven, Effect of Polyvalent Metal-Silicate Hydrosols on the Floation of Calcite, Aime Preprint, 78--B-322.

Atademir, M. R., J. A. Kitchener and H. L. Shergold, The Surface Chemistry and Flotation of Scheelite, Jnl., Coll. & Interface Sci., 71, No. 3, 466-476, (1979).

Coghill, Will H. and J. Bruce Clemmer, Soap Flotation of the Nonsulfides, Tr. Aime, 112, 449, (1935).

Kunze, Keith, Milling Tungsten Ore at the Getchell Mine, Mining Congress Jnl., 39, 31-33, (1953).

Steane, H. A., Tungsten Milling at Canadian Exploration Ltd., 6th Commonwealth Mining & Metallurgical Congress—Northern Miner Press, Toronto, 1957, pp. 418-429.

Kipp, H. H., Development of Tungsten Ore Dressing Practice, Tr. CIM, 60, 76-78, (1957).

Anon, New Tungsten Mine Opens in Canada's Northwest Region, E. & M. J., Jan. 1963.

Ellerman, Roy, Operations of Canada Tungsten Mining Corporation Limited, Deco Trefoil, M4-B13, (1969), pp. 9-23.

Murray, R. J., Tungsten Recovery in the King Island Scheelite Mill, Aus. IMM Conference, Tasmania, May 1977, pp. 119-127.

Cummings, W. W. and D. E. Bruce, Canada Tungsten—Change to Underground Mining & Description of Mine-Mill Procedures, CIM Bulletin, Aug. 1977, pp. 94-101.

Pazour, Donald A., Union Carbide Increases Tungsten Production with New Nevada Mine, World Mining, pp. 56-59, Aug. 1978.

Anon, Austrian Scheelite Mill, Mining Magazine, p. 625, Jun. 1978.

Anon, Photometric Ore Sorting at Mount Carbine Wolframite Mine, Queensland, Mining Magazine, pp. 28-37, Jan. 1979.

Grasberg, Matts, New Swedish Scheelite Flotation Process Results, World Mining, pp. 54-58, Mar. 1979.

Anon, Turn Around at Yxsjoberg, Mining Magazine, pp. 519-531, Jun. 1980.

Karahan, Sabri, Ahmet Demirci and Ragip Atademir, Turkish Tungsten Producer Redesigns for Efficiency, World Mining, Sep. 1980.

Bibliography, compiled by L. Green, Jrgrl Library, May 8, 1978.

Agar, G. E., R. Stratton-Crawley and T. J. Bruce, Optimizing the Design of Flotation Circuits, CIM Bulletin, vol. 73, Dec. 1980, pp. 173-181.

White, L. G., The Canada Tungsten Property, Flat River Area, Northwest Territories, The Canadian Mining & Metallurgical Bulletin for May, 1963, Montreal, pp. 390-393.

Leaver, E. S. and M. B. Royer, Flotation for Recovery of Scheelite from Slimed Material, U.S. Bureau of Mines, Technical Paper 585, 1938, pp. 1-24.

Ottley, Derek J., Technical, Economic and Other Factors in the Gravity Concentration of Tin, Tungsten, Columbium, and Tantalum Ores, Minerals Sci. Engng., vol. 11, No. 2, Apr. 1979, pp. 99-121.

$Na_2SiO_3$ vs. $Na_2CO_3$
RECOVERY OF W IN FIRST CLEANER CONCENTRATE

SCHEELITE FLOTATION PROCESS

The present invention relates to the separation of scheelite ($CaWO_4$) from gangue found in the same ore and particularly to a process of separating and concentrating scheelite by froth flotation.

Scheelite is a valuable source of tungsten and is often found in low grade ore deposits containing e.g. 0.4% tungsten in association with the gangue minerals garnet, quartz, feldspar, calcite and sulphide-containing minerals. Scheelite is usually separated from the gangue material by grinding the ore, subjecting the coarse fraction of the ground ore to gravitational separation and subjecting the fine fraction to froth flotation using a fatty acid, e.g. oleic acid, as the collector, sodium silicate as a modifying agent to suppress silicate flotation and sodium carbonate to regulate the pH of the flotation pulp liquor to about 10. However this process produces a low-grade concentrate (about 25% tungsten) which must be treated chemically to up-grade it to a tungsten content in excess of 52% (65% $WO_3$).

We know of only two froth flotation processes that give high-grade concentrates at acceptable tungsten recoveries.

The first process of froth flotation results in a concentrate containing 69.6% $WO_3$ with a 93% tungsten recovery and is reported in a paper entitled "Selective depression of silicates in scheelite flotation with fatty acids" by Auge Bahr and Köser (pages 691 to 712 of the proceedings of 11th Inter. Miner. Process Congr.—Rome 1975). In this process, a pulp is conditioned prior to flotation with sodium hydroxide, sodium silicate and fatty acids at high temperatures (60°–80° C.). The cost of heating all the pulp, however, renders this process unattractive.

The second process gives a concentrate containing 73.4% $WO_3$ with tungsten recovery of 80% and is reported in World Mining (March 1979) pages 54 to 58. However, no details of this process have been published so far.

We know of only two proposals to froth float scheelite using a paraffin oil, however neither produces satisfactory results. The first proposal is described in a paper entitled "Mineral processing of bismuth-tungsten ore at Akagane Mine, Japan" by Shoji et. al. (pages 667 to 679 of the proceedings of the 10th Inter. Miner. Process Congr.—London 1973) and involves the froth flotation of an extremely low-grade ore (0.025% $WO_3$) using 10 grams per tonne oleic acid and 100 g/tonne kerosene as collectors. However, the grade of the concentrate produced by this process is very low at 0.3% $WO_3$.

The second proposal is described in U.S. Pat. No. 4,208,275 in which 0.5 lb./ton (0.22 g/kg) of tall oil and a similar quantity of kerosene are used as collectors. The pulp from which scheelite is floated contains 4.0 lb./ton (1.8 g/kg) sodium carbonate, 11.0 lb/ton (4.9 g/kg) sodium silicate, 0.1 lb/ton Dowfroth 250 and 0.5 lb/ton (0.2 g/kg) lanolin. The flotation is carried out at 20° C. but the rougher concentrate grade is only 15.0% $WO_3$ with a $WO_3$ recovery of 79%.

The present invention is based on the surprising discovery that by using a paraffin oil in the flotation pulp and by carefully correlating the amounts of fatty acid collector, sodium silicate and sodium carbonate used in the pulp, highly selective scheelite separation can be achieved at good tungsten recoveries.

According to the present invention there is provided a process of separating scheelite from gangue in an ore, which process comprises grinding the ore with 4 to 10 g/kg of an alkali metal carbonate, selectively separating sulphide minerals present in a pulp of the ore and then selectively separating scheelite from the remaining pulp by froth flotation in the presence of a paraffin oil, from 0.1 to 0.4 g/kg of a fatty acid or a soap thereof, and from 3.2 to 5.5 g/kg of sodium silicate, wherein the ratio by weight of paraffin oil to fatty acid is in the range of from 0.5:1 to 2.8:1 and wherein the amount of oil, alkali metal carbonate and sodium silicate are so correlated that a stable height of froth is maintained on top of the pulp during the flotation.

In the present specification, all percentage figures are based on weight and when it is stated that reagents are added in an amount measured in grams per kilogram, that amount is based on the grams of reagent added per kilogram of dry ore.

The conditions used in any process depend on the precise nature of the ore to be treated. However, the choice of conditions within the limits defined above is merely a matter of optimisation which is preferably carried out in a manner that will be described in detail later.

We have found that the addition of the alkali metal carbonate (sodium salt is preferred for economic reasons) to the mill is important since when it is added to the pulp of the ground ore, for example just prior to the rougher stage of the flotation, the grade of the concentrate obtained by the process falls dramatically.

The ore is preferably ground wet to produce a pulp. The solids content of the pulp may be high e.g. about 55% solids.

Before scheelite can be floated, sulphide minerals in the ore must be removed e.g. by flotation, preferably using dodecylmercaptan as the collector although other known collectors may alternatively be used. The dodecylmercaptan is preferably added to the ore in the grinding mill to ensure its complete dispersion in the pulp. 0.15 g/kg of dodecylmercaptan is usually sufficient to achieve adequate flotation of the sulphide minerals. Methyl isobutyl carbinol may be used as a frother in which case creosote is preferably also added to reinforce the froth and stop it from collapsing. The floated sulphide minerals are discarded as far as the present process is concerned.

Following sulphide flotation, the pulp may be conditioned by adding the sodium silicate, paraffin oil and fatty acid (or soap thereof) in the amounts required in the process, although a portion of the fatty acid and oil required may be added before or during the rougher stage.

Scheelite flotation may consist of a rougher stage together with one or more (preferably one) scavenger stages and one or more cleaner stages (preferably two) although the precise number of cleaner and scavenger stages depends on the grade of scheelite concentrate and the distribution of scheelite between the concentrate and the tailings in the rougher stage.

The fatty acid (or soap thereof) acts as a collector for scheelite flotation and any fatty acid or fatty acid soap that is customarily used in scheelite flotation may be used in the present process e.g. oleic acid. The amount of acid or soap present in the rougher stage is in the range of 0.1 to 0.4 g/kg since lower additions result in low tungsten recovery and higher additions lead to a non-selective flotation and hence a low-grade concentrate. The precise acid or soap addition must be determined empirically in order to arrive at the best compromise between the grade of the concentrate and the tungsten recovery, but the optimum addition is usually between 0.2 and 0.3 g/kg and more usually about 0.3 g/kg.

The paraffin oil in the rougher stage greatly improves tungsten recovery. We have found that for the majority of ores an oil to fatty acid ratio of 1.5:1 will produce optimum results but the ratio may be as high as 2.8:1 before the tungsten recovery and concentrate grade become unacceptable, although there is nothing to be gained from using a ratio in excess of 2:1. Below a ratio of 0.5:1, the advantages of the oil addition decrease. The nature of the oil is not of primary importance but the best results have been obtained using kerosene, diesel oil and domestic fuel oil and these oils are preferred. However, a more exotic oil Sunpar 100, which is white, dewaxed paraffin oil, has given satisfactory results. As will be appreciated from the fact that diesel oil can be used, the oil need not be absolutely pure and, in particular, it can contain aromatic compounds.

The pulp should contain from 3.2 to 5.5 g/kg of sodium silicate. It is a non-stoichiometric compound having the general formula n $Na_2O$. m $SiO_2$ where the modulus $^m/n$ has a value between 2.2 and 3.2 in commercial grades. It is preferred to use sodium silicate having as high a modulus as possible because that results in a high level of dissolved silicate for a given sodium silicate addition. It is highly advantageous for the dissolved silicate level at the end of the rougher stage to be in the range of from 0.8 to 1.2 grams per liter of pulp liquor, more preferably about 1 g/liter. Sodium silicate and sodium carbonate are the most important variables in the present process since not only are the grade and recovery of scheelite determined by the amount of these compounds in the pulp, but they also determine the froth stability. Deviation from the optimum amounts of either compound can result in a dramatic drop in the concentrate grade or in the recovery or both.

Sodium carbonate is usually added to scheelite flotation processes to adjust the pH. We have found, however, that it plays a much more important role under the particular conditions prevailing in the present process since, as discussed above, it affects the grade of the concentrate, the tungsten recovery and the froth stability. The optimum quantity of sodium carbonate in the pulp varies markedly from one type of ore to another and it would not be unexpected to use an amount of sodium carbonate to obtain optimum results for one ore that is double the amount required for another ore. However, the approximate amount of this reagent required can be guessed from inspection of the ore—underground ores requiring about 4 g/kg and surface ores about 7 to 9 g/kg. The exact optimum amount can be found empirically, preferably, by using a scheme described later in the specification.

The control of froth in the rougher stage of the process of the present invention is difficult because the degree of frothing does not appear to depend on the presence of a frother, but depends on the amounts of sodium carbonate, sodium silicate and oil present. Sodium silicate and paraffin oil suppress frothing and accordingly when either reagent is present in excess, frothing is insufficient and when present in insufficient amounts, the froth is uncontrollable. Also when too much oil is present a skin forms on the flotation cell and floated scheelite cannot be removed. Sodium carbonate, on the other hand, has the opposite effect on froth generation, that is to say, too little causes insufficient frothing and too much causes an uncontrollable froth and results in poor selectivity and a low-grade concentrate.

Although, they have no hitherto observable effect in the rougher stage, frothers do generate froth in the cleaner and scavenger stages. Thus it is preferred that little or no frother is added at the rougher stage in case it is added in excess, and an unmanageable froth is formed in the cleaner stages. However, frother is preferably added to the cleaner stages in conventional amounts e.g. 0.01 g/kg of DOWFROTH 250.

Temperature does not affect the process of the present invention markedly and so it is preferably performed at ambient temperature.

A small quantity of guar gum improves the efficiency of the present process and accordingly it may be added, preferably just prior to the rougher stage, in a quantity of about 0.02 g/kg.

The cleaner and scavenger stages of the froth flotation process are conventional and so will not be described in detail now. Preferably, however, the pulp is conditioned prior to the first cleaner stage with about 3 g/kg sodium silicate.

The optimum quantity of each reagent can be found by any method, but we have found that the following scheme works very well:

(1) Estimate the sodium carbonate addition by inspection of the ore. If it is oxidized, 7 to 8 g/kg of sodium carbonate should be added to the mill and if it is not oxidized 4 g/kg should be added, (2) grind the ore with the sodium carbonate and sufficient water to obtain a pulp containing 55% solids, (3) add 4 g/kg of sodium silicate in which the molar $SiO_2$:$Na_2O$ ratio is 3.2:1, prior to 0.3 g/kg of a fatty acid and 0.45 g/kg of diesel oil, (4) subject the pulp to flotation for five minutes, (5) analyze the pulp liquor for dissolved silica ions, which should be present in an amount of 1 g/l. If less than that is present, more sodium silicate should be added in step (3) and if more than that is present, the amount of sodium silicate added in step (3) should be decreased. Steps (4) and (5) should be repeated until the correct silicate ion concentration is obtained.

(6) If the froth in step (4) is too voluminous, the amount of sodium carbonate added in step (1) should be reduced and if the froth is too flat, it should be increased. The ideal froth is one of constant depth in which some froth sorting occurs and which facilitates the removal of the scheelite concentrate without undue inclusion of pulp. Steps (1) to (4) should be repeated until the amount of sodium carbonate addition is such that the correct sort of froth is obtained.

(7) pH is a useful guide to the correct sodium carbonate addition since we have found that the correct amount of carbonate is usually present when the pH is 10.3. If the pH is below the figure, more carbonate should be present and if it is above that figure less carbonate should be present. This measurement of pH is only a guide to the carbonate addition needed and pH does not appear to be a critical factor per se.

(8) If the recovery of scheelite is low, the amount of oil and fatty acid in the rougher stage should be altered to obtain the maximum recovery. An oil:fatty acid ratio of 1.5:1 should always be maintained because we have found that it is the optimum value for nearly all ores.

Figure 2:
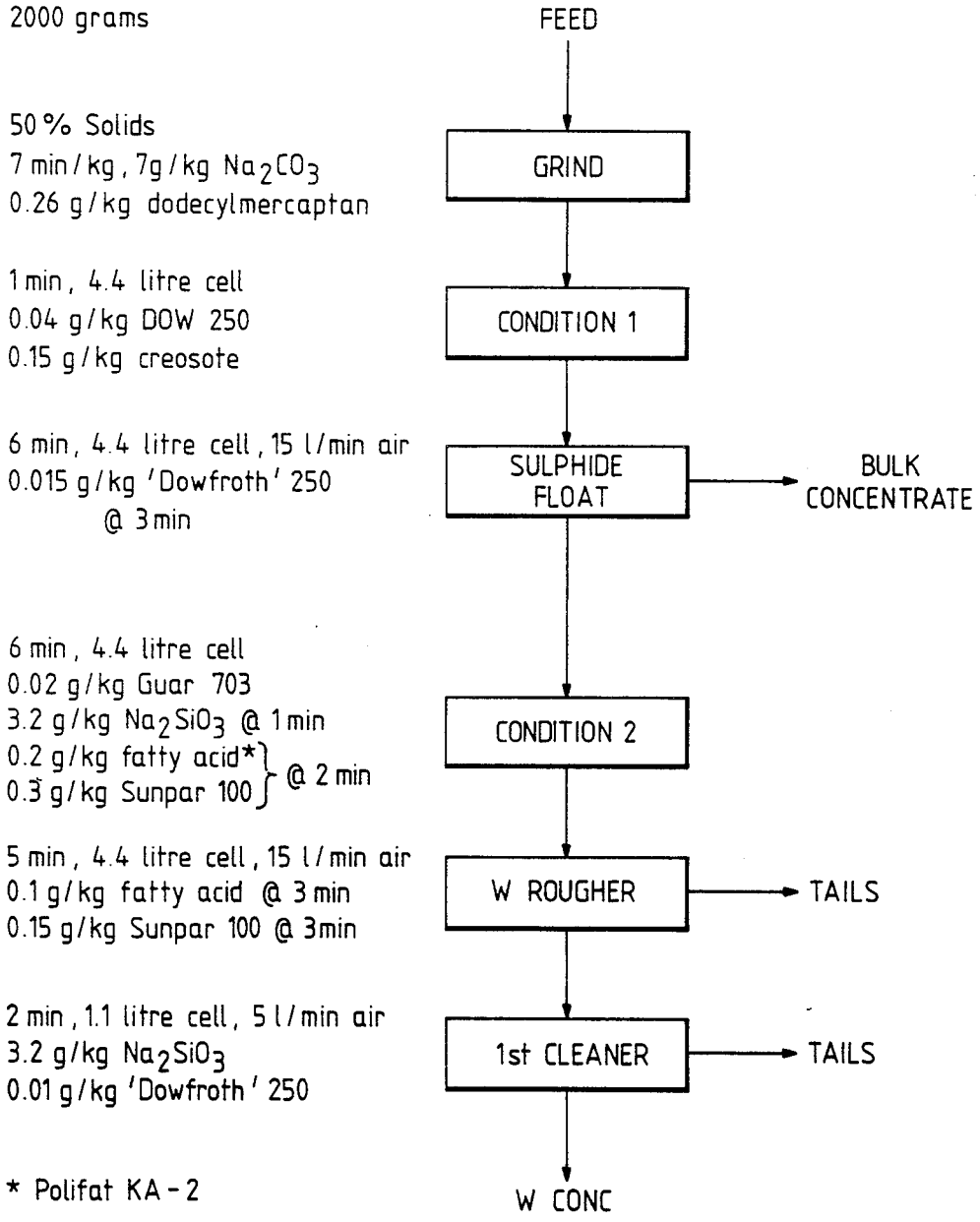
Figure 3:
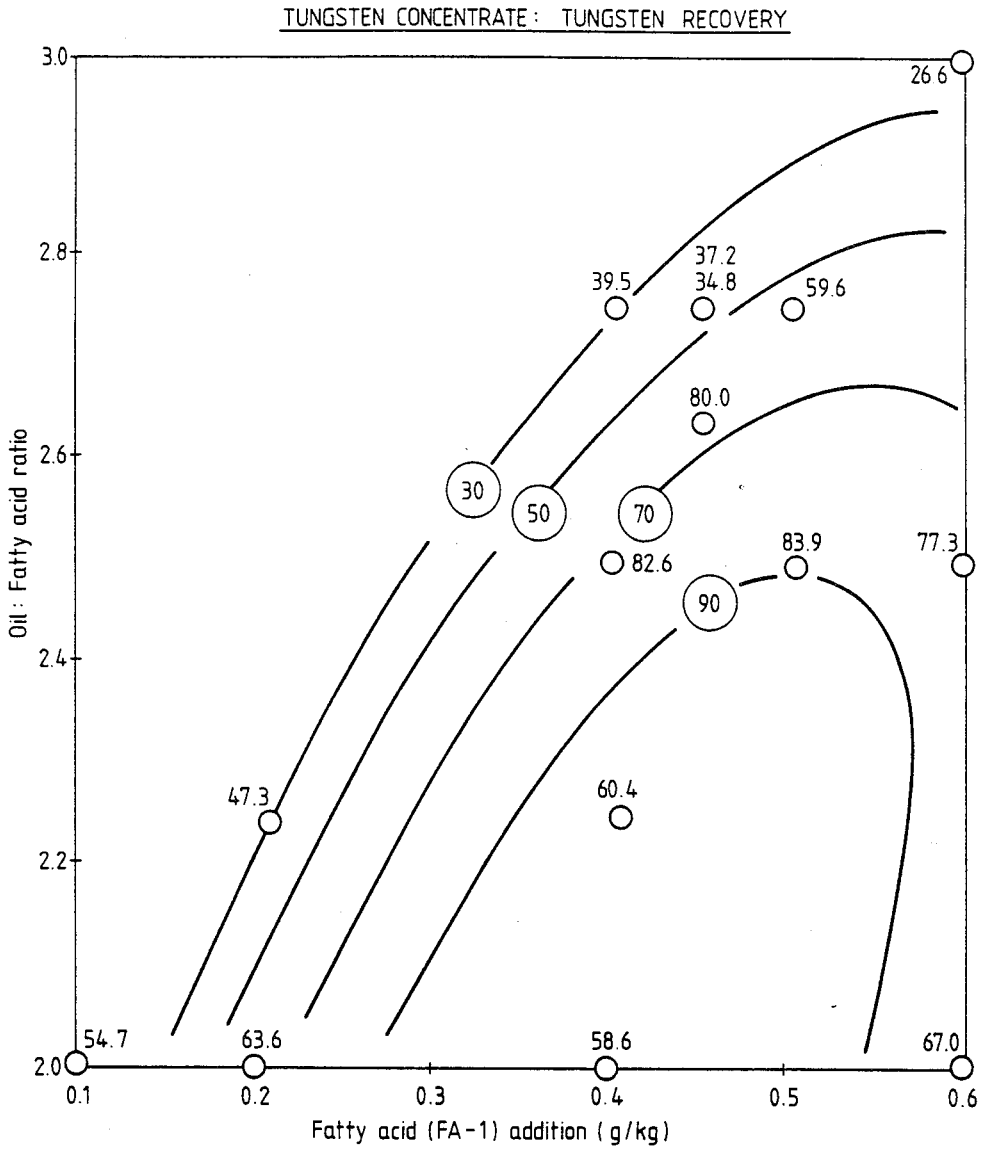
Figure 4:
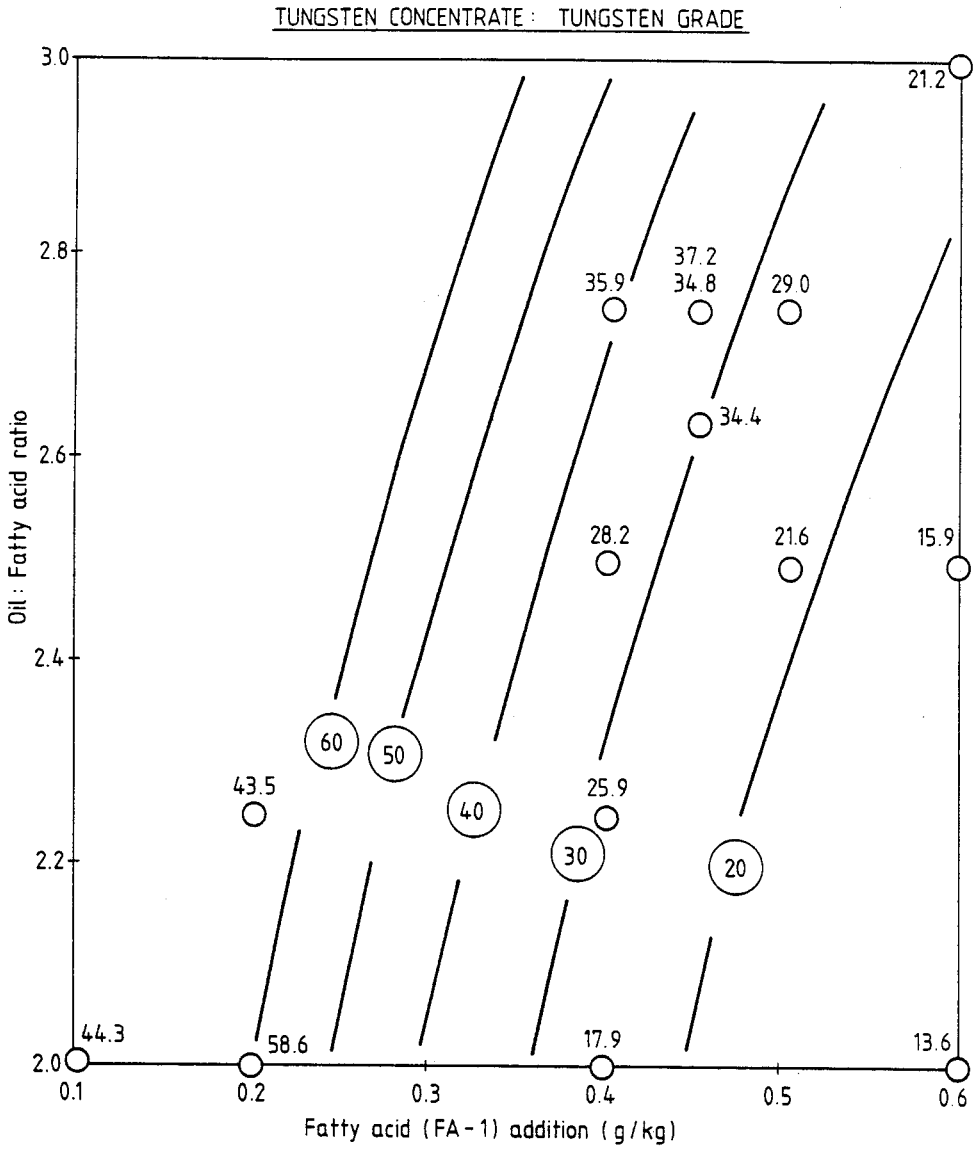
Figure 5:
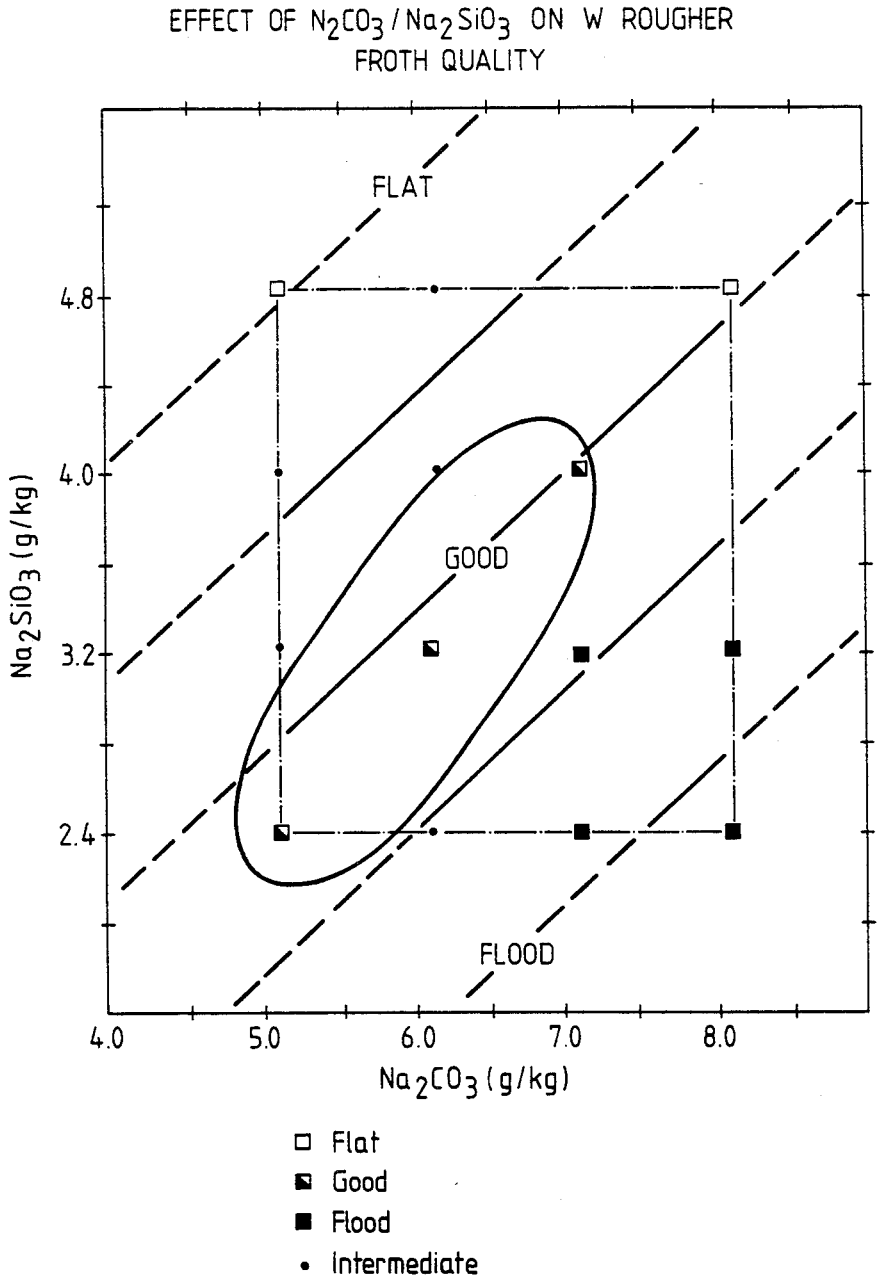
Figure 6:
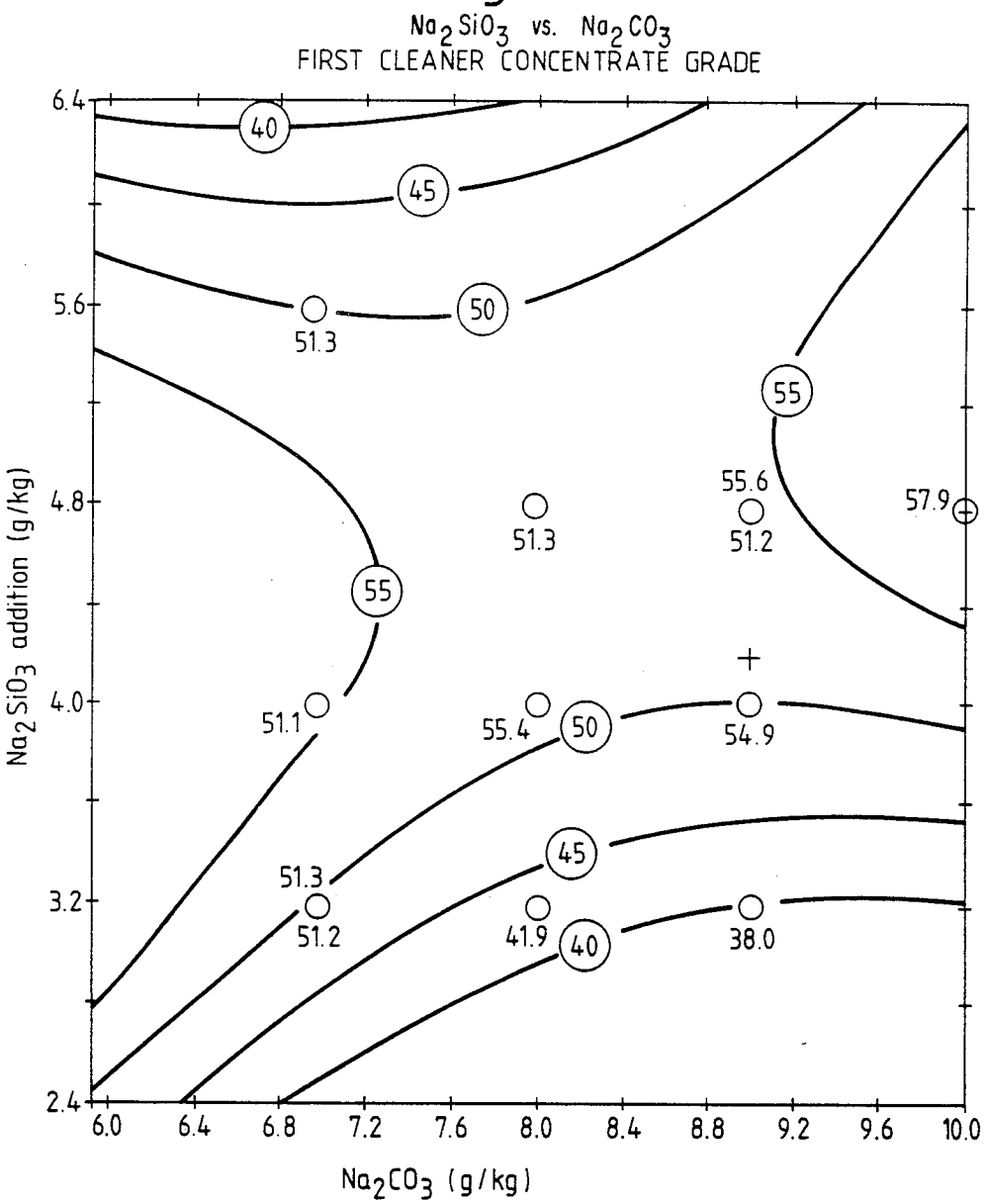
Figure 7:
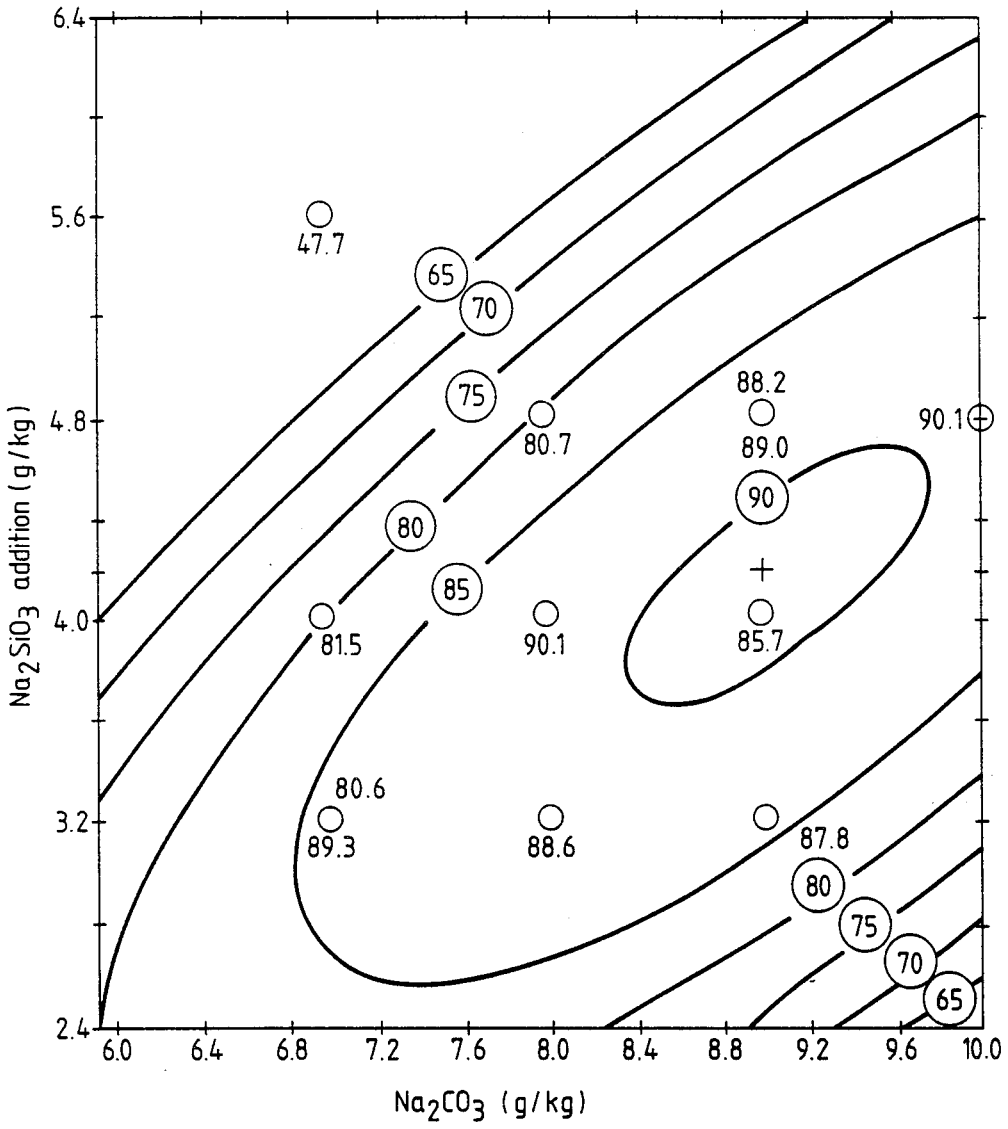
Figure 8:
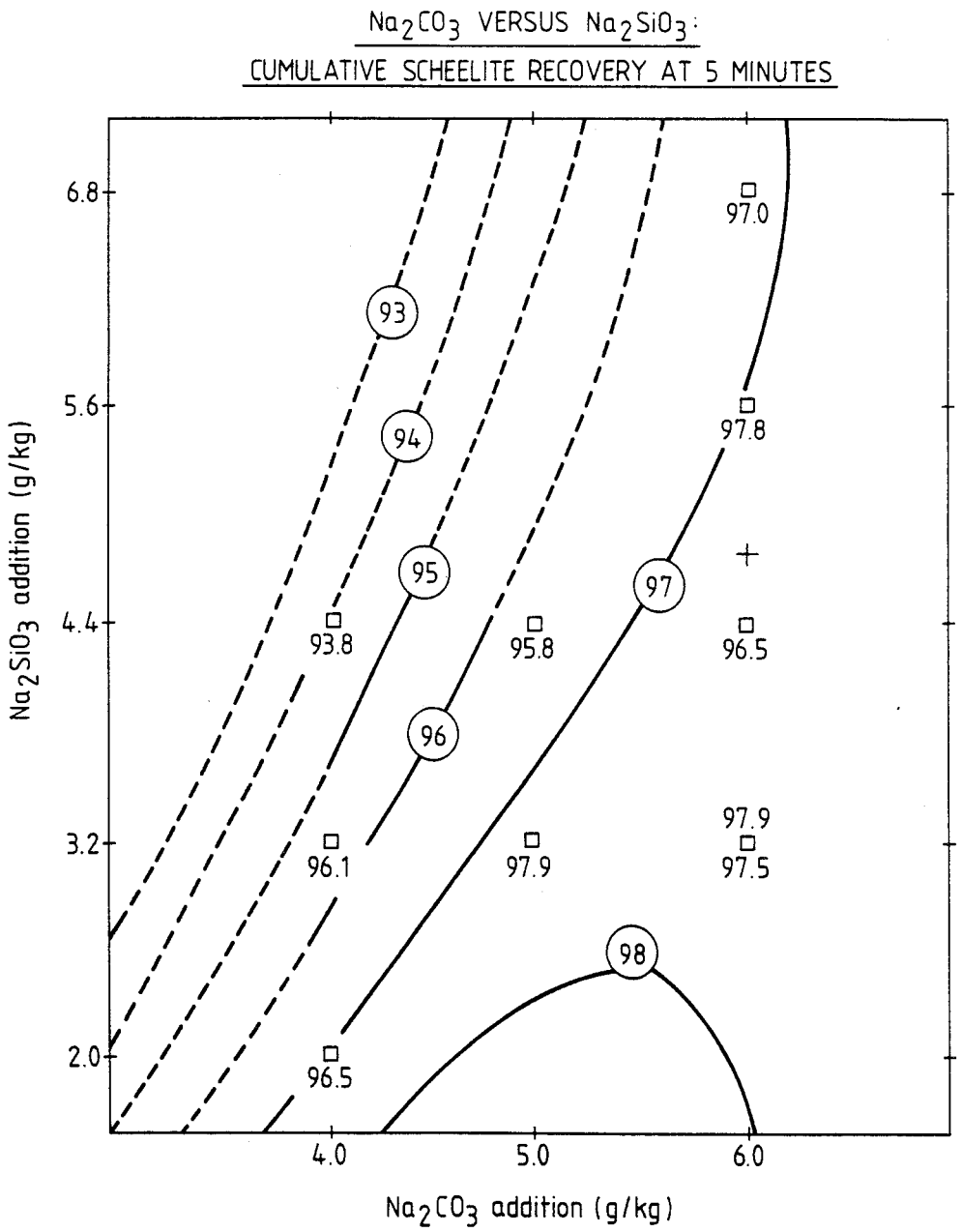
Figure 9:
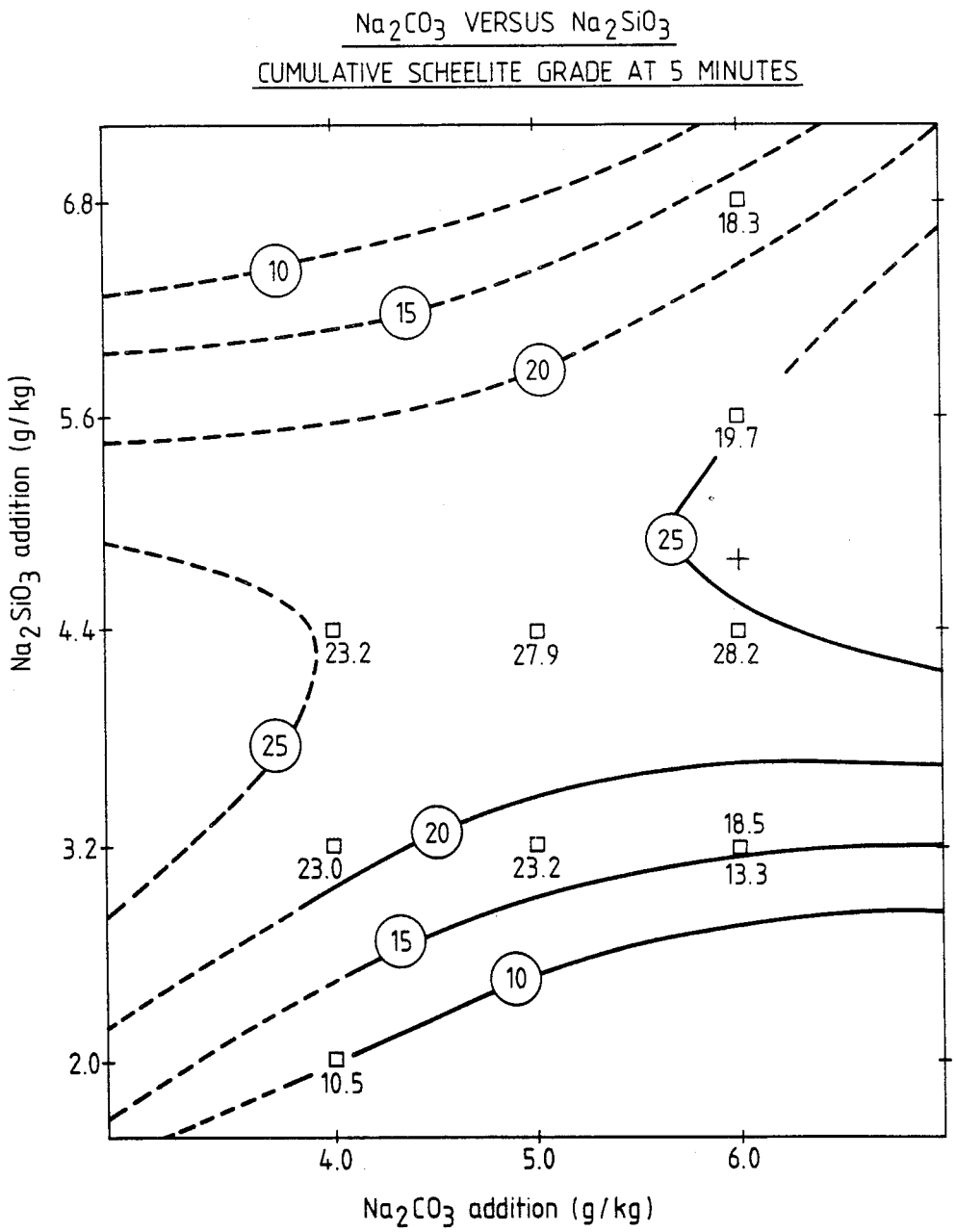
Figure 10:
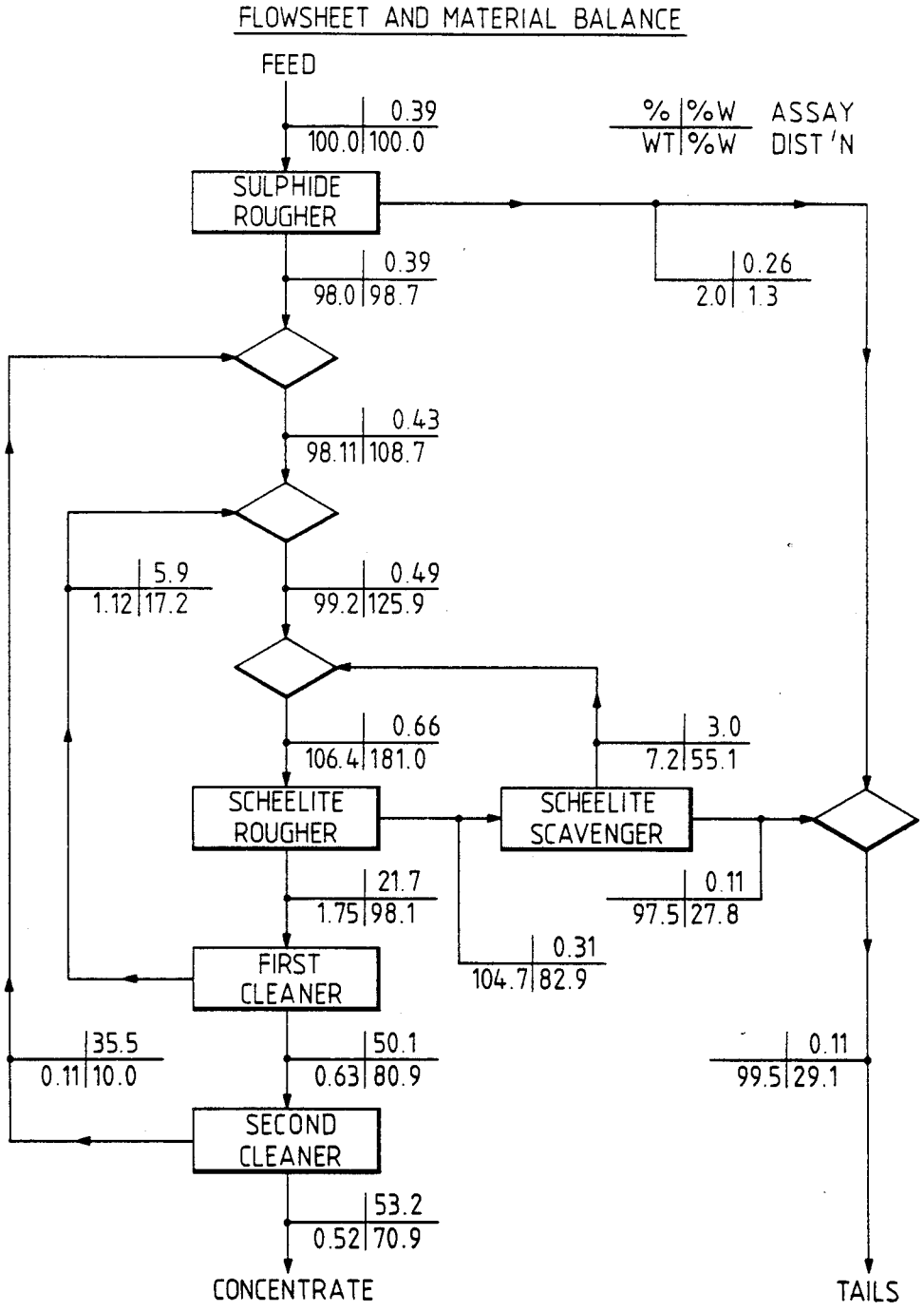

The present invention will now be described in greater detail in the following Examples 1 to 8. In the Examples, reference is made to the accompanying drawings in which:

FIGS. 1, 2 and 10 show flow charts of processes according to the present invention, FIGS. 3 and 4 are plots giving the results of Example 5, FIG. 5 is a plot giving the results of Example 6, FIGS. 6 and 7 are plots giving results of Example 7, and FIGS. 8 and 9 are plots giving the results of Example 7.

EXAMPLE 1

Referring to FIG. 1, 2 kg of ore were ground together with 2 kg water, 7 g/kg of sodium carbonate and 0.15 g/kg dodecylmecaptan for 14 minutes. The ground ore pulp was then subjected to flotation by passing 15 liters of air through the pulp per minute for 7 minutes and the sulphide minerals floated and were subsequently discarded. 0.05 g/kg of DOWFROTH 250, which is a commercially available frothing agent, was added to the pulp which was then conditioned for 4 minutes. At the beginning of the conditioning stage 3.2 g/kg sodium silicate was added. After 1 minute of the condition had elapsed, 0.2 g/kg of fatty acid Polifat KA-2 and 0.3 g/kg of fuel oil were added to the pulp. (Polifat KA-2 is a composition containing at least 96% fatty acids and is available from Aceites Polimerisados S.A. of Mexico City). The pulp was then subjected to the rougher stage and a further 0.1 g/kg of KA-2 fatty acid and 0.15 g/kg of fuel oil were added to the pulp. 15 liters/min of air were passed through the pulp for five minutes. The tailings were discarded while the floated concentrate was conditioned for 1 minute with 3.2 g/kg sodium silicate. After conditioning, the first cleaning stage was carried out by adding 0.02 g DOWFROTH 250 and passing 5 liters of air per minute through the pulp for two minutes. The tailings were discarded and the concentrate subject to the second cleaner step which was identical to the first cleaner step. The concentrate of the second cleaner step was the final tunsgten concentrate.

EXAMPLE 2

A process similar to that described in Example 1 is shown in the flow diagram of FIG. 2, and the exact process conditions are shown in that Figure. The distribution and tungsten assay of various process streams are as follows:

| | Assay | Distribution % | |
|---|---|---|---|
| | % W | Wt. | W |
| Concentrate | 64.5 | 1.1 | 94.1 |
| 1st Cleaner Tails | 3.5 | 0.3 | 1.5 |
| Rougher Tails | 0.03 | 93.5 | 3.7 |
| Sulphide Concentrate | 0.11 | 5.1 | 0.7 |
| Total | 0.76 | 100 | 100 |

The rougher concentrate contained 50.4% W. Thus it can be seen that a high-grade concentrate (64.5% W) can be obtained at a high recovery (94.1%) solely by froth flotation.

EXAMPLE 3

The process of this Example is identical to that described in Example 2 except that the amount of Sunpar 100 oil used was 0.15 g/kg instead of 0.45 g/kg. The results were as follows:

| | Assay | Distribution % | |
|---|---|---|---|
| | % W | Wt. | W |
| Concentrate | 63.7 | 0.9 | 82.0 |
| 1st Cleaner Tails | 2.6 | 0.4 | 1.5 |
| Rougher Tails | 0.12 | 93.6 | 15.8 |
| Sulphide Concentrate | 0.09 | 5.1 | 0.6 |
| Total | 0.71 | 100 | 100 |

The rougher concentrate contained 44.4% W.

By comparing the results of Examples 2 and 3, it can be seen that a reduction in the oil addition from 0.45 to 0.15 g/kg causes a drop in the tungsten recovery from 94 to 82%.

EXAMPLE 4

Two tests were performed that used the same conditions as Examples 2 and 3 except that the final cleaner step was omitted and the concentrate was sampled over a period of time. One test used 0.15 g/kg of SUNPAR 100 oil and the other 0.45 g/kg. The rates of flotation of scheelite and gangue in the two tests were calculated and found to be as follows:

0.15 g/kg oil addition:

$R_s=0.987\ [1-\exp(-0.329\ (t+1.13))]$ $R_g=0.024\ [1-\exp(-0.215\ (t+0.027))]$ 0.45 g/kg oil addition:

$R_s=0.96\ [1-\exp(0.923\ (t+0.105))]$ $R_g=0.026\ [1-\exp(0.110\ (t+0.155))]$ where $R_s$ stands for scheelite recovery $R_g$ stands for gangue recovery t stands for time in minutes.

Using a method described in a paper by Agar et al entitled "Optimising the Design of Flotation Circuits" in CIM Bulletin, 73, No. 824 December 1980 pages 173 to 181, the optimum flotation times were calculated. The results were as follows:

| Oil addition (g/kg) | Optimum time (min.) | Scheelite recovery after 5 min. (%) |
|---|---|---|
| 0.15 | 33 | 85.6 |
| 0.45 | 7 | 95.1 |

The cumulative concentrate grades after 6 minutes of flotation were 25.6% W and 30.9% with oil additions of 0.15 and 0.45 g/kg respectively.

These tests show that an increase in the addition of oil increases the rate of scheelite flotation and improves the separation of scheelite from gangue as can be seen from the fact that the optimum time decreases from 33 minutes to 7 minutes when using 0.45 g/kg of oil instead of 0.15 g/kg.

EXAMPLE 5

The procedure of Example 2 was followed in several tests except that the oil and fatty acid additions were varied. The tungsten recovery and the tungsten content of the concentrate (by weight percentage) at various oil and fatty acid additions are shown graphically in FIGS. 3 and 4. These figures also include contour lines showing the additions needed to obtain various tungsten recoveries and concentrate grades. From these results it can be seen that increasing the fatty acid addition increases the scheelite recovery but decreases the grade of the concentrate and that increasing the oil:fatty acid ratio above 2.0 improves neither the concentrate grade nor the recovery. By extrapolating the contour lines between the bands, it can be seen that useful results will be obtained at oil:fatty acid ratios less than 2.0 with fatty acid additions between 0.2 and 0.3 g/kg.

EXAMPLE 6

This Example shows the effect of sodium silicate and sodium carbonate on the froth generated in the process.

A series of experiments were carried out on a particular grade of scheelite ore using 0.3 g/kg of fatty acid and 0.45 g/kg of oil and varying amounts of sodium silicate and sodium carbonate. Three separate types of froth were identified (1) a flood condition where the contents of the cell flow uncontrollably into the concentrate receiver, (2) a flat condition when scheelite floats at the liquid-air interface but no froth can be generated to permit removal of the concentrate and (3) good conditions when a normal depth of froth is obtained in which some froth sorting occurs and which facilitates the removal of concentrate from the pulp without undue inclusion of pulp. The results are shown in FIG. 5 with flood conditions being shown by the symbol ■, flat conditions by □, good conditions by ◪ and intermediate conditions by ●. The best froth conditions were obtained within the cigar-shaped boundary in FIG. 5 and it can be seen that the quality of the froth depends both on the quantities of sodium silicate and sodium carbonate in the pulp. Although not shown in FIG. 5, the optimum concentrate grades and recoveries for the particular ore used were obtained in the top half of the cigar-shaped area.

EXAMPLE 7

This Example shows the effect of sodium silicate and sodium carbonate on the grade of the concentrate and recovery of tungsten. In this Example, the amounts of oil, sodium carbonate and sodium silicate were not necessarily correlated to give a good froth. This procedure was adopted so that the optimum additions of sodium carbonate and sodium silicate could be found. The floated concentrate was removed by suction.

Flotation was brought about in a rougher stage and one cleaner stage. In the rougher stage, 0.3 g/kg of fatty acid, 0.45 g/kg of a paraffin oil, and varying amounts of sodium silicate and sodium carbonate were used. 0.32 g/kg of sodium silicate were added prior to the cleaner stage. The results are shown graphically in FIGS. 6 and 7, which show the grade of the concentrate and the tungsten recovery after the cleaner stage respectively with varying amounts of sodium carbonate and sodium silicate used in the rougher stage. The Figures also include bands showing the reagents need to obtain various grades and recoveries. From the plots in FIGS. 6 and 7, it can be seen that the additions needed to obtain an optimum combination of concentrate grade and recovery for the particular ore used were about 4.2 g/kg sodium silicate and 9.0 g/kg sodium carbonate. Three tests produced results near the optimum.

| Sodium silicate (g/kg) | Sodium carbonate (g/kg) | Concentrate (%) | |
|---|---|---|---|
| | | Grade | Recovery |
| 4.8 | 9 | 55.6 | 88.2 |
| 4.8 | 9 | 51.2 | 89.0 |

-continued

| Sodium silicate (g/kg) | Sodium carbonate (g/kg) | Concentrate (%) | |
|---|---|---|---|
| | | Grade | Recovery |
| 4.0 | 9 | 54.9 | 85.7 |

It is clear from FIGS. 6 and 7 that the process is sensitive even to small changes in the amounts of the reagents used and that such changes can result in unsatisfactory results. For example, by adding excess sodium silicate to the rougher pulp of the ore used in this Example, but keeping all other factors constant, the recovery of scheelite will fall. The grade will also decrease but not as rapidly as the recovery. This indicates that the addition of excess sodium silicate depresses scheelite flotation but does not affect the gangue. On the other hand, if the amount of sodium silicate added is less than the optimum both the recovery and the concentrate grade decrease. Likewise, if the sodium silicate addition is maintained at its optimum (4.2 g/kg) and the amount of sodium carbonate is changed, the concentrate grade and the recovery suffer.

Besides the effects of sodium silicate and sodium carbonate on the recovery of scheelite and on the grade of the concentrate, account must be taken of froth properties. The data set out in Example 6 cannot be compared directly with that of this Example because Example 6 uses a different type of ore. However, it is believed that the general interdependence of sodium silicate and sodium carbonate in froth generation shown in FIG. 5 occurs when froth floating all types of scheelite ores. We have found, however, that maximum recoveries and concentrate grades occur at approximately the same sodium silicate and sodium carbonate additions as acceptable frothing properties. Thus the exact amounts of sodium carbonate and sodium silicate used need only be adjusted slightly (if at all) to obtain acceptable frothing.

EXAMPLE 8

This Example demonstrates that the amounts of reagents needed to give optimum recovery and concentrate grade depend on the ore.

In Example 7, samples of ore from Mexico were treated whereas in this Example the ore was of Canadian origin. A series of tests similar to those described in Example 7 were carried out on samples of the Canadian ore using a rougher stage and a single cleaning stage only. The amounts of fatty acid and oil used were the same as those in Example 7 i.e. 0.3 g/kg and 0.45 g/kg respectively. The amounts of sodium carbonate and sodium silicate used in the rougher stage were varied to optimise the tungsten recovery and the concentrate grade. The results are shown in FIGS. 8 and 9. It can be seen from these plots that the amounts of sodium silicate and sodium carbonate that give the optimum results were approximately 4.8 g/kg and between 5 and 6 g/kg respectively as compared to 4.2 and 9.0 g/kg respectively in Example 7. Thus the amount of sodium silicate is about the same, whereas the amount of sodium carbonate is very different in the two Examples.

EXAMPLE 9

This Example shows the results of a pilot plant that processes about 61 metric tonnes of scheelite-containing ore per day. A flow sheet of the process involved is set out in FIG. 10, which also shows the tungsten assay and the tungsten and weight distributions (based on the feed) of each process stream in a single shift of the plant. The reagents used in the shift were as follows (in g/kg).

| | | |
|---|---|---|
| sodium carbonate | 5.4 | added to the grinding mill |
| dodecylmercaptan | 0.09 | |
| creosote | 0.23 | added just prior to |
| DOWFROTH 250 | 0.1 | sulphide flotation |
| sodium silicate | 4 | added to the condition |
| fatty acid | 0.3 | preceding the scheelite |
| diesel oil | 0.45 | rougher |
| sodium silicate | 2.9 | added to the first cleaner. |

The weighted average for ten consecutive shifts of the pilot plant was as follows:

| | Assay W | Distribution (%) | |
|---|---|---|---|
| | (%) | Weight | W |
| Concentrate | 53.9 | 0.54 | 71.4 |
| Tails | 0.11 | 99.46 | 28.6 |
| Feed | 0.40 | 100 | 100 |

I claim:

1. A process of separating scheelite from gangue in an ore, which process comprises grinding the ore with 4 to 10 grams of an alkali metal carbonate per kilogram of ore, selectively separating sulphide minerals present in a pulp of the ore and then subjecting the pulp comprising desulfided pulp and pulp liquor to froth flotation to separate selectively scheelite, said flotation being carried out in the presence of a paraffin oil, from 0.1 to 0.4 gram of a fatty acid or a soap thereof per kilogram of ore and from 3.2 to 5.5 grams of sodium silicate per kilogram of ore, wherein the ratio by weight of paraffin oil to fatty acid is in the range of from 0.5:1 to 2.8:1 and wherein the amount of oil, alkali metal carbonate and sodium silicate are so correlated that a stable height of froth is maintained on top of the pulp during the flotation, and said froth being controlled by adjusting the sodium silicate level in the flotation to obtain a dissolved silicate level of about 0.8 to about 1.2 grams per liter of pulp liquor and adjusting the initial alkali metal carbonate level according to the condition of the froth at such dissolved silicate level.

2. A process as claimed in any one of claim 1, wherein the molar ratio of $SiO_2$ to $Na_2O$ in the sodium silicate is about 3.2:1.

3. A process as claimed in any one of claim 1, in which guar gum is added to the flotation pulp.

4. A process as claimed in any one of claim 1, wherein the scheelite flotation comprises, apart from a rougher stage, at least one cleaner stage.

5. A process as claimed in any one of claim 1, wherein the paraffin oil is diesel oil or domestic fuel oil.

6. A process as claimed in any one of claim 1, wherein the selective separation of sulphide material is by froth flotation.

7. A process as claimed in claim 1, wherein the solids content of the pulp is about 50% up to about 55%.

8. A process as claimed in claim 1, wherein the fatty acid addition is at least about 0.2 g/kg.

9. A process as claimed in claim 1, wherein the initial amount of alkali metal carbonate ground with the ore is estimated based on the condition of the ore, the initial amount of alkali metal carbonate added to an ore which is essentially a surface ore being the equivalent of about 7 to 9 grams of sodium carbonate power kilogram of ore.

10. A process as claimed in claim 1, wherein the carbonate level is adjusted in the initial stage to produce a pH of about 10.3 in the flotation pulp liquor.

11. A process as claimed in claim 1, wherein the froth of the rougher flotation stage is treated in at least one additional cleaner step and prior to such cleaner step an additional amount of sodium silicate is added to such froth.

12. A process as claimed in claim 1, wherein the amount of fatty acid or soap thereof used during flotation is in the range of from 0.2 to 0.3 g/kg.

13. A process as claimed in claim 1 or claim 12, wherein the ratio of paraffin oil to fatty acid is in the range 1:1 to 2:1.

14. A continuous process of separating scheelite from gangue in an ore, which process comprises grinding the ore with 4 to 10 grams of an alkali metal carbonate per kilogram of ore, selectively separating sulphide minerals present in a pulp of the ore, subjecting the pulp comprising desulfided pulp and pulp liquor to a rougher froth flotation stage to separate selectively scheelite into a rougher concentrate, said flotation being carried out in the presence of a paraffin oil, from 0.1 to 0.4 gram of a fatty acid or a soap thereof per kilogram of ore and from 3.2 to 5.5 grams of sodium silicate per kilogram of ore, wherein the ratio by weight of paraffin oil to fatty acid is in the range of from 0.5:1 to 2.8:1 and wherein the amount of oil, alkali metal carbonate and sodium silicate are so correlated that a stable height of froth is maintained on top of the pulp during said rougher flotation stage, and subsequent to said rougher flotation stage, treating the rougher concentrate in at least one cleaner stage to produce a float and nonfloat product portion followed by recycling the nonfloat portion from the cleaner stage to the rougher froth flotation stage, said rougher flotation froth being controlled by adjusting the sodium silicate level in the flotation to obtain a dissolved silicate level of about 0.8 to about 1.2 grams per liter of pulp and adjusting the initial alkali metal carbonate level according to the condition of the forth at such dissolved silicate level.

15. A process as claimed in claim 14, wherein the froth of the rougher flotation stage is treated in at least one additional cleaner step and prior to such cleaner step an additional amount of sodium silicate is added to such froth.

* * * * *